US005265575A

United States Patent [19]

Norota

[11] Patent Number: 5,265,575

[45] Date of Patent: Nov. 30, 1993

[54] APPARATUS FOR CONTROLLING INTERNAL COMBUSTION ENGINE

[75] Inventor: Kazuhiko Norota, Toyota, Japan

[73] Assignee: Toyota Jidosha Kabushiki Kaisha, Aichi, Japan

[21] Appl. No.: 811,328

[22] Filed: Dec. 20, 1991

[30] Foreign Application Priority Data

Dec. 25, 1990 [JP] Japan ..... 2-405621
Dec. 25, 1990 [JP] Japan ..... 2-405622

[51] Int. Cl.[5] ..... F02D 41/14
[52] U.S. Cl. ..... 123/436; 123/571
[58] Field of Search ..... 123/419, 436, 571; 364/431.08

[56] References Cited

U.S. PATENT DOCUMENTS 5,060,618 10/1991 Takaoka et al. ..... 123/436
5,156,128 10/1992 Nakagawa ..... 123/436
5,176,118 1/1993 Norota ..... 123/436 X

FOREIGN PATENT DOCUMENTS 271634 10/1989 Japan .

*Primary Examiner*—Tony M. Argenbright
*Attorney, Agent, or Firm*—Kenyon & Kenyon

[57] ABSTRACT

An apparatus for controlling a control parameter of a multicylinder internal combustion engine so that a cycle-by-cycle torque variation is equal to a target torque variation after an inter-cylinder correction for bringing the quantities of torque generated in a plurality of cylinders into agreement is performed. In the engine control apparatus, a modification part modifies a range within which a torque variation correction factor can change into a narrower range, when it is judged that the inter-cylinder correction has not been completed, so that a control part generates an appropriate control parameter based on first correction factors calculated by a first calculation part and the torque variation correction factor calculated by a second calculation part even when the inter-cylinder correction routine has not been completed.

10 Claims, 12 Drawing Sheets

| | | | | | |
|---|---|---|---|---|---|
| Q | $K_{30}$ | $K_{31}$ | $K_{32}$ | $K_{33}$ | $K_{34}$ |
| N | $K_{20}$ | $K_{21}$ | $K_{22}$ | $K_{23}$ | $K_{24}$ |
| S | $K_{10}$ | $K_{11}$ | $K_{12}$ | $K_{13}$ | $K_{14}$ |
| M | $K_{00}$ | $K_{01}$ | $K_{02}$ | $K_{03}$ | $K_{04}$ |

800 NE 3200 (rpm)

FIG. 11

APPARATUS FOR CONTROLLING INTERNAL COMBUSTION ENGINE

BACKGROUND OF THE INVENTION (1) Field of the Invention

The present invention generally relates to an engine control apparatus for an internal combustion engine, and more particularly to an apparatus for controlling operating parameters of a multicylinder internal combustion engine, the operating parameters including fuel injection correction factors or exhaust gas recirculation factors, controlling of the operating parameters being performed, during a fuel injection correction process with respect to the cylinders, the torque variation being so adjusted to agree with a target torque variation.

(2) Description of the Related Art

A conventional fuel injection control device is known, for controlling fuel injection quantities of a multicylinder internal combustion engine. Japanese Laid-Open Patent Application No. 1-271634, for example, discloses a fuel injection quantity control device for a multicylinder internal combustion engine. In this device, a combustion pressure sensor for detecting a combustion pressure is mounted in one of a plurality of cylinders of the engine. A cycle-by-cycle torque variation is calculated on the basis of a signal indicative of the combustion pressure being output by the pressure sensor each time a combustion/expansion stroke occurs in the cylinder. A feedback process of correcting a fuel injection quantity is performed by making an air-fuel mixture in the engine as lean as possible (or, making the air-fuel ratio as close to its lean-side limit as possible), in such a way that the calculated torque variation is adjusted so as to be approximately equal to a given target torque variation.

The fuel injection quantity control process is performed by this conventional device so as to make the cycle-by-cycle torque variation approach its lean-side limit; this fuel injection quantity control is called hereinafter a lean-limit control. By performing such a lean-limit control process, the fuel consumption can be improved and the quantity of nitrogen oxides NOx in the exhaust gas can be effectively reduced.

In the above conventional device, in order to avoid increase of manufacturing costs as well as complexity of the control method, a single combustion pressure sensor is mounted on only one cylinder among the plurality of cylinders. But, a signal output by this combustion pressure sensor cannot be used directly in the fuel injection quantity control as the representative pressure of all the combustion pressures produced in the cylinders. The fuel injection quantities to be injected into the cylinders inherently have various limits at which a misfire may occur if the fuel injection quantity exceeds the limit, and there are variations of the quantity of recirculated exhaust gas due to the differences of valve clearances in the cylinders. Thus, if the signal output by the combustion pressure sensor is used directly as the representative combustion pressure, a misfire may occur in any cylinder and the torque variations in the plurality of cylinders become greater.

In the above conventional device, therefore, differences in the generated torque between the cylinders are detected from the time required for a combustion and expansion stroke to take place in each of the cylinders, and an inter-cylinder correction process is performed for eliminating the torque differences and bringing the quantities of torque generated in the cylinders into agreement with one another by correcting an air-fuel ratio in each of the cylinders. After this inter-cylinder correction process has been completed, the above described lean limit control process is started.

However, in the conventional device there is a problem in that it is necessary to meet prescribed operating conditions of the engine before correction factors used for the inter-cylinder correction process are calculated, and a considerable time period is required for the inter-cylinder correction process to be completed. For calculating the correction factors, data must be collected more than a prescribed number of repetitions not only when each cylinder is subjected to a combustion/expansion stroke but also when each cylinder is in a fuel cut mode. Collecting of the data when each cylinder is in the fuel cut mode (not in the combustion and expansion stroke) is required for eliminating measuring errors in the data. But, when the engine is operating in a certain driving pattern, the operating condition of the engine in the fuel cut mode is only occasionally satisfied. Therefore, the conventional device in such a case requires a considerable time period to elapse until the inter-cylinder correction process is completed.

In the above described case, although the engine is in a suitable operating condition (warm-up condition, engine speed, load, etc.) for the lean limit control step to be performed for efficient fuel consumption, the conventional device cannot perform the lean limit control procedure for adjusting the air-fuel ratio to its lean side limit, while the inter-cylinder correction process is being performed. If the air-fuel ratio feedback control procedure is performed, for converging the ratio toward the stoichiometric value, the fuel consumption, when the inter-cylinder correction process has not been completed, deteriorates.

SUMMARY OF THE INVENTION

Accordingly, it is a general object of the present invention to provide an improved engine control apparatus in which the above described problems are eliminated.

Another and more specific object of the present invention is to provide an engine control apparatus in which an air-fuel ratio feedback control is performed with a narrower range of a torque variation correction factor while an inter-cylinder correction routine is being performed, the range when the inter-cylinder correction routine has not been completed being narrower than a range of the same after the fuel injection correction process has been completed. The above mentioned objects of the present invention can be achieved by an engine control apparatus which includes a first calculation part for calculating first correction factors with respect to a plurality of cylinders of an internal combustion engine, the first correction factors being calculated so as to make the quantities of torque generated in the cylinders substantially agree with one another, a second calculation part for calculating a second correction factor with respect to the plurality of cylinders so that a cycle-by-cycle torque variation in at least one of the cylinders is changed so as to substantially agree with a target torque variation, a control part for generating a control parameter with respect to each of the cylinders for appropriate operation of the internal combustion engine, on the basis of the first correction factors and the second correction factor, a discrimination part for judging whether or not an inter-cylinder correction routine has been completed based on the first correction factors so that the quantities of torque generated in the cylinders substantially agree with one another, and a modification part for modifying a range within which the second correction factor can change into a narrower range when the discrimination part judges the inter-cylinder correction routine has not been completed, allowing the control part to generate the control parameter based on the first correction factors and the second correction factor even when the inter-cylinder correction routine is being performed. According to the present invention, it is possible to perform the lean limit control without causing a misfire in the cylinders while the fuel injection correction process is not completed. When the engine is running continuously in an operating condition such that the fuel injection correction process is not soon completed, fuel consumption can be improved and the quantity of nitrogen oxides NOx in the exhaust gas can be reduced effectively in the case of the engine control apparatus according to the present invention.

Other objects and further features of the present invention will become more apparent from the following detailed description when read in conjunction with the accompanying drawings.

BRIEF DESCRIPTION OF THE DRAWINGS

FIG. 11 is a diagram showing a two-dimensional map with a set of learning areas in which fuel injection correction factors are stored in response to operating conditions of the engine.

DESCRIPTION OF THE PREFERRED EMBODIMENT

Figure 1:
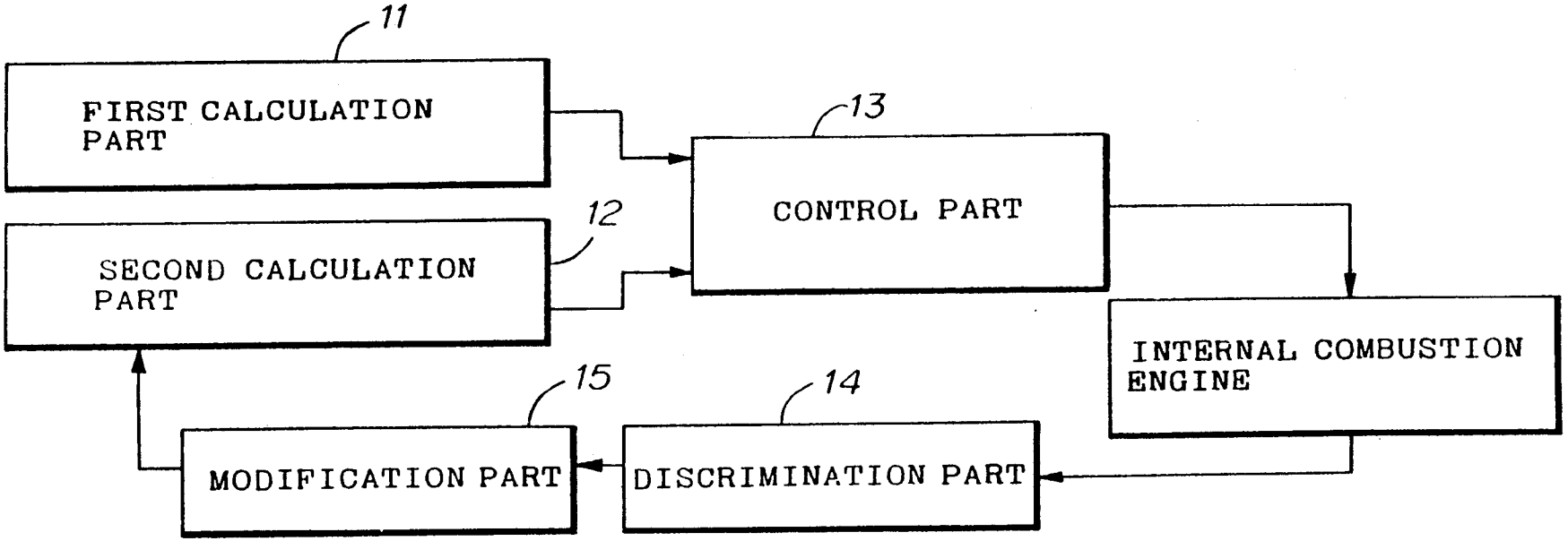
FIG. 1 is a block diagram showing the construction of an engine control apparatus according to the present invention.

A description will now be given of a construction of an engine control apparatus according to the present invention, with reference to FIG. 1. In FIG. 1, a first calculation part 11 calculates first correction factors with respect to a plurality of cylinders of an internal combustion engine, the first correction factors being calculated so as to make the quantities of torque generated in the cylinders substantially agree with one another. A second calculation part 12 calculates a second correction factor with respect to the plurality of cylinders so that a cycle-by-cycle torque variation in each of the cylinders is changed so as to substantially agree with a target torque variation. The second correction factor falls within a range between a lower limit and an upper limit. A control part 13 generates a control parameter with respect to each of the cylinders for appropriate operation of the internal combustion engine, the control parameter being obtained on the basis of the first correction factors from the first calculation part 11 and the second correction factor from the second calculation part 12. A discrimination part 14 judges, in each operation cycle, whether or not an inter-cylinder correction routine has been completed based on the first correction factors, for making the quantities of torque generated in the cylinders substantially agree with one another. A modification part 15 modifies a range within which the second correction factor can change into a narrower range when the discrimination part 14 judges the inter-cylinder correction routine has not been completed, allowing the control part 13 to generate the control parameter based on the first correction factors and the second correction factor, while the inter-cylinder correction routine is being performed.

Figure 2:
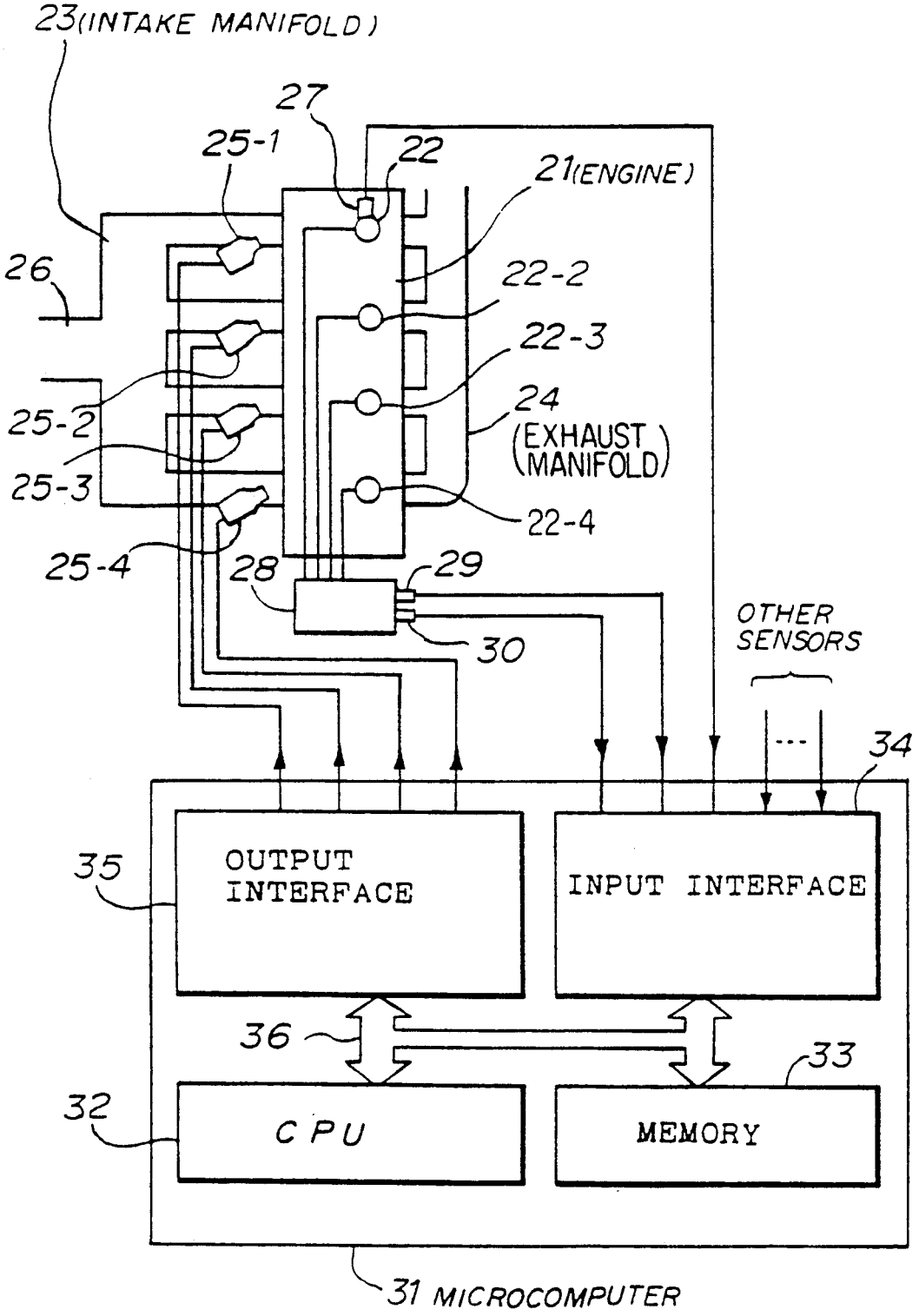
FIG. 2 is a diagram showing an internal combustion engine including a microcomputer to which the present invention is applied.

FIG. 2 shows the construction of a four-cylinder, spark-ignition type internal combustion engine to which the present invention is applied. The internal combustion engine 21 shown in FIG. 2 includes four cylinders #1, #2, #3, #4 and four spark plugs 22-1, 22-2, 22-3, 22-4 which are respectively mounted on walls of the four cylinders. The engine 21 also includes an intake manifold 23 and an exhaust manifold 24, each combustion chamber of the cylinders being connected to the intake manifold 23 communicating with an intake passage 26 provided upstream of the engine. Each combustion chamber of the four cylinders is also connected to the exhaust manifold 24 communicating with an exhaust pipe on the outlet side of the engine. Four fuel injection valves 25-1, 25-2, 25-3, 25-4 are respectively mounted on four branch pipes leading to the intake manifold 23. A combustion pressure sensor 27 is mounted on the cylinder #1. This combustion pressure sensor 27 is preferably a heat-resistant, piezoelectric sensor which receives directly a combustion pressure produced in a combustion chamber of the cylinder #1 and generates a signal indicative of the combustion pressure produced therein.

A distributor 28 supplies high voltage in proper sequence to the four spark plugs 22-1 to 22-4. A reference position sensor 29 and a crank angle sensor 30 are mounted on the distributor 28. The reference position sensor 29 generates a detection signal indicating a reference position of a crankshaft each time the crankshaft's rotation angle has reached 720 deg CA (crank angle). The crank angle sensor 30 generates a detection signal indicating a crank angle of the crankshaft each time the crankshaft's rotation angle increases by 30 deg CA.

As shown in FIG. 2, a microcomputer 31 includes a central processing unit (CPU) 32, a memory 33, an input interface 34 and an output interface 35. These components of the microcomputer 31 are interconnected by a bi-directional bus 36. The signals generated by the combustion pressure sensor 27, the reference position sensor 29, the crank angle sensor 30 and other sensors are each input to the input interface 34. The output interface 35 supplies control signals to the fuel injection valves 25-1 through 25-4, in proper sequence, for controlling ignition times at which fuel is injected by the fuel injection valves 25-1 through 25-4. The above mentioned parts 11 through 15 of the apparatus according to the present invention are realized by the microcomputer 31 shown in FIG. 2.

Figure 3:
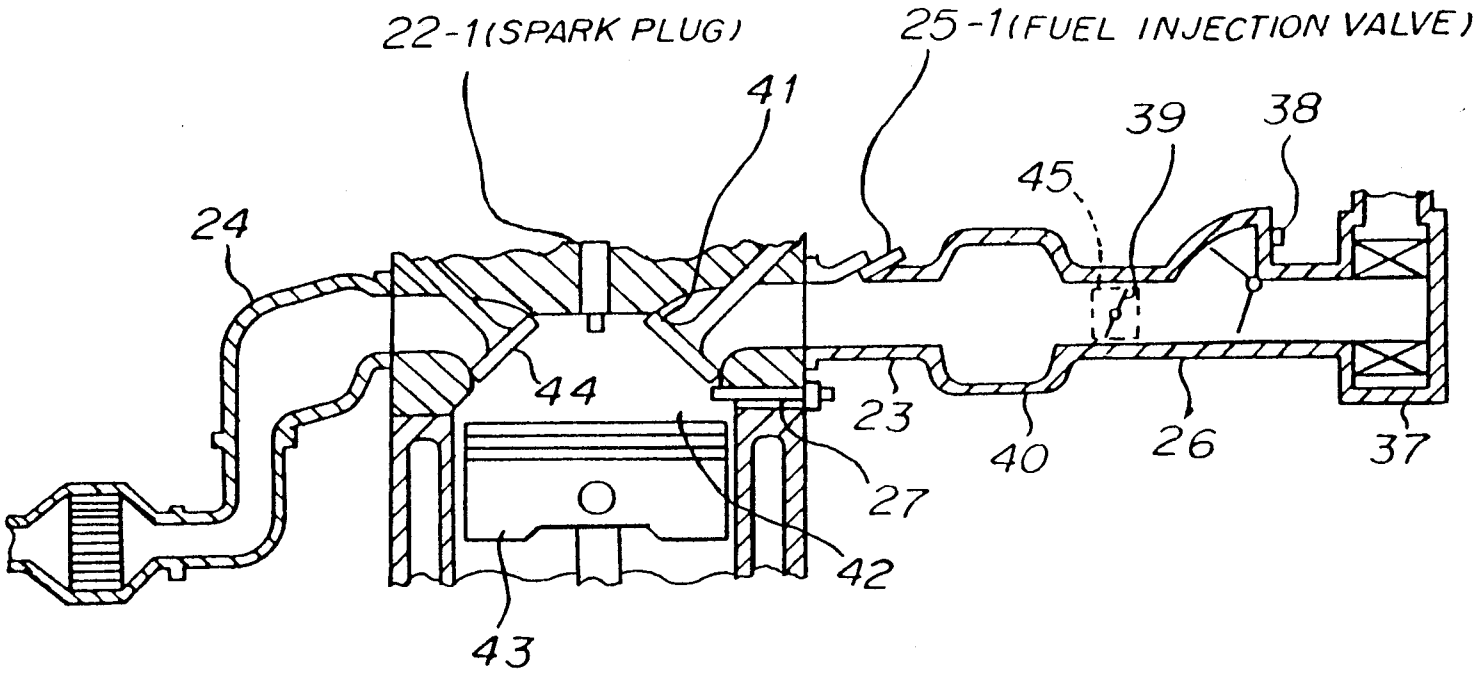
FIG. 3 is a sectional view showing the construction of one cylinder and its related portions of the internal combustion engine shown in FIG. 2.

FIG. 3 shows the construction of the cylinder #1 shown in FIG. 2 and other related portions in the vicinity of the cylinder #1. In FIG. 3, those parts which are essentially the same as those corresponding parts in FIG. 2 are designated by the same reference numerals; a description thereof will be omitted. In FIG. 3, an air cleaner 37 for filtering external air entering the intake passage 26 is provided at an edge portion of the intake passage 26, and an air flow meter 38 for measuring a flow rate of air passing through the intake passage 26 is provided downstream of the air filter 37. A throttle valve 39 for controlling the flow of air passing through the air cleaner 37 is provided at an intermediate portion of the intake passage 26 downstream of the air flow meter 38. The air passing through the throttle valve 39 is appropriately fed, by a surge tank 40, into the intake manifold 23 leading to the four cylinders of the engine. In a case of the cylinder #1 shown in FIG. 3, the air sent from the surge tank 40 is mixed with the fuel injected by the fuel injection valve 25-1, and an air-fuel mixture is fed into a combustion chamber 42 of the cylinder #1 via an intake valve 41 when the intake valve 41 is open during operation of the engine.

A piston 43 is arranged within the combustion chamber 42. The combustion chamber 42 leads to the exhaust passage 24 via an exhaust valve 44. The above combustion pressure sensor 27 is secured in an engine block in such a way that a leading edge of the sensor 27 projects into the combustion chamber 42. A reference numeral 45 designates the throttle position sensor for detecting a valve open position of the throttle valve 39, and this throttle position sensor 45 sends a signal indicating the valve open position of the valve 39 to the input interface 34 of the microcomputer 31.

Next, a description will be given of fuel injection control procedures which are performed by the microcomputer 31. The fuel injection control procedures according to the present invention include a fuel injection correction routine shown in FIGS. 4 and 5, a torque variation control routine shown in FIG. 6 and a fuel injection time calculation routine shown in FIG. 7. According to the present invention, these routines are performed by the microcomputer 31, so that the above described lean limit control is carried out and the fuel injection time control is carried out at the optimum level of fuel injection quantity when the fuel injection correction routine is being performed.

Figure 4:
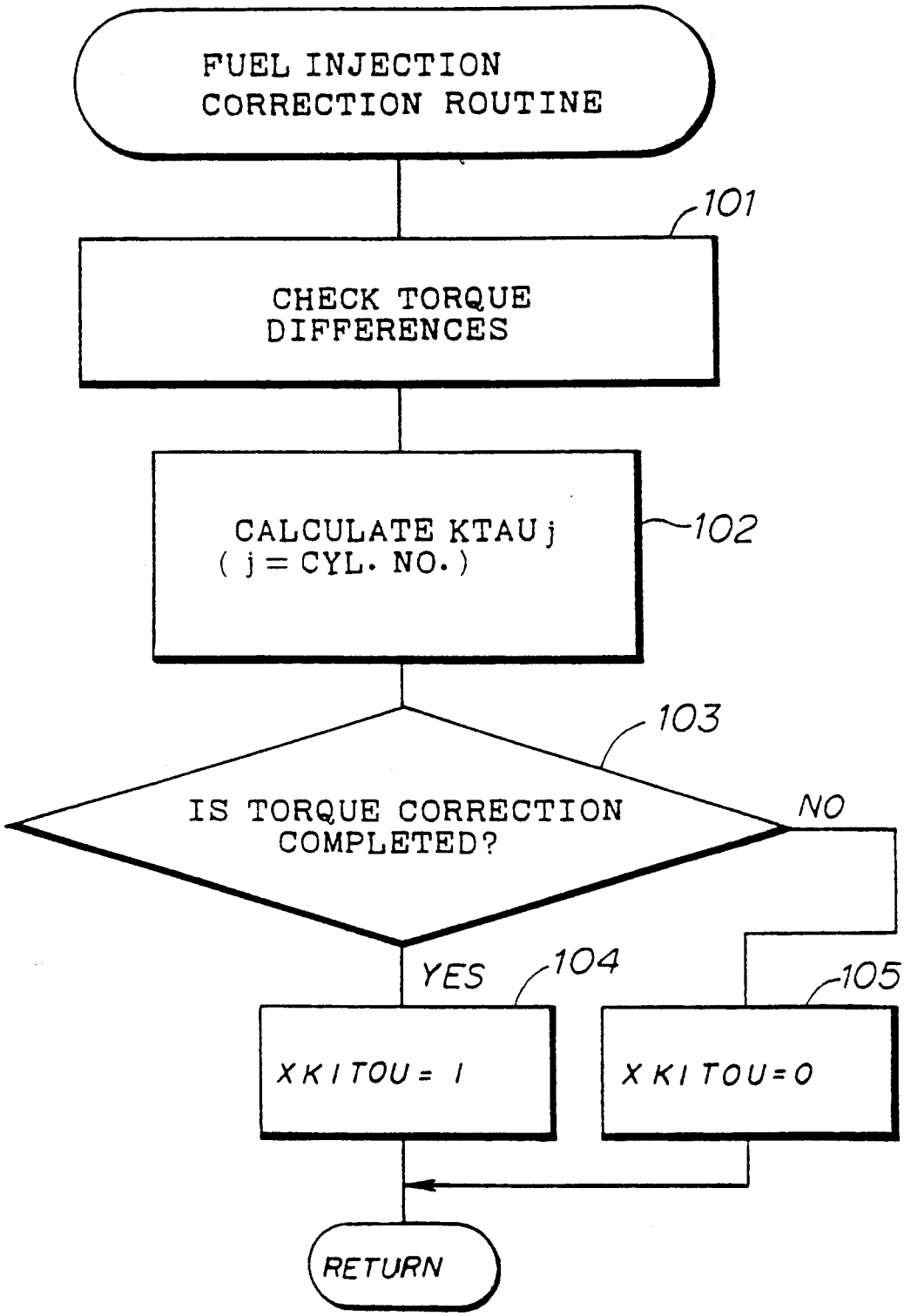
FIG. 4 is a flow chart for explaining an outline of an inter-cylinder correction routine which is performed for bringing the quantities of torque generated in the cylinders into agreement.

FIG. 4 shows an outline of the fuel injection correction routine by which the quantities of torque generated in the four cylinders are brought into agreement with one another. In the flow chart shown in FIG. 4, a step 101 checks differences of torque generated in the cylinders. In this step 101, a determination is made as to which cylinder torque is greater than the torque average of the four cylinders. A step 102 calculates first correction factors KTAUj (j=cylinder number) of the respective cylinders (j=1 to 4). The above mentioned first calculation part 11 of the present invention is realized by performing the step 102 shown in FIG. 4.

A step 103 determines, on the basis of a parameter used when the first correction factors KTAUj are calculated, whether or not the inter-cylinder correction process has been completed. The above mentioned discrimination part 14 of the present invention is realized by performing the step 103. If the inter-cylinder correction process has been completed, a step 104 sets a correction completion flag XKITOU to 1, and this routine ends. If the inter-cylinder correction process has not been completed, a step 105 sets the correction completion flag XKITOU to zero, and this routine ends.

Figure 5:
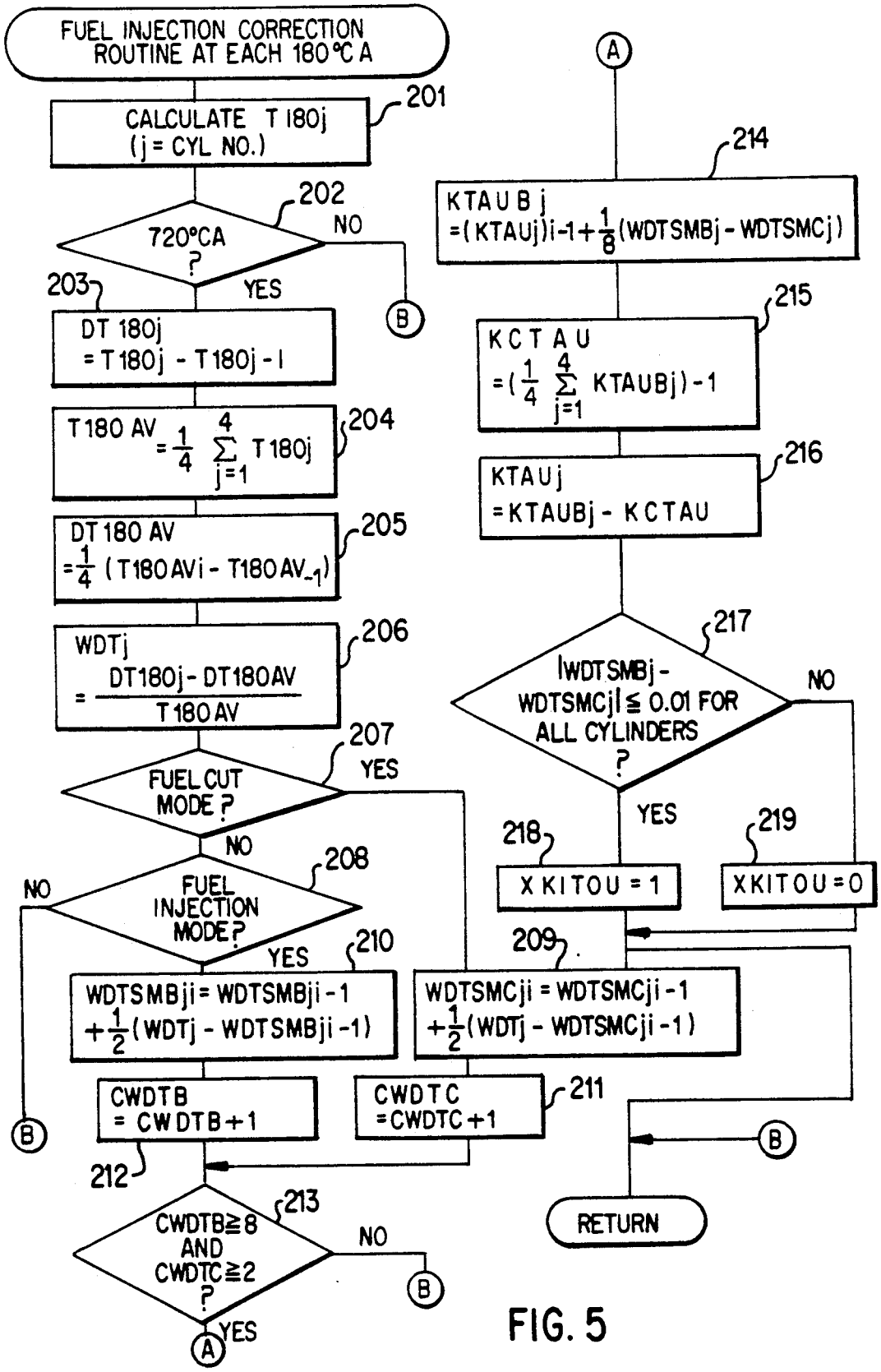
FIG. 5 is a flow chart for explaining the details of the inter-cylinder correction routine shown in FIG. 4.

FIG. 5 shows the details of the first correction routine which is performed according to the present invention. The routine shown in FIG. 5 is initiated each time the crank angle of the crankshaft indicated by the signal sent from the crank angle sensor 30 is equal to 180 deg CA, corresponding to a top dead center (TDC) or a bottom dead center (BDC). A step 201 calculates a combustion stroke time T180j (j=1 to 4) required for each of the pistons in the cylinders (j) to travel from the TDC position to the BDC position. A step 202 determines whether the crank angle indicated by the signal from the crank angle sensor 30 has reached the crank angle of 720 deg CA. If the crank angle has not reached 720 deg CA, then the fuel injection correction routine ends.

If the crank angle has reached 720 deg CA, data of the combustion stroke time T180j with respect to each of the four cylinders #j (j=1 to 4) is obtained. A combustion stroke is performed in a given sequence of the cylinder number, which combustion stroke may take place in the cylinders #j, for example, in the order of cylinder numbers #1, #3, #4, #2. A step 203 calculates a difference DT180j, with respect to each of the four cylinders, between the preceding combustion stroke time T180j−1 for which the preceding combustion has occurred in one cylinder #(j−1) and the current combustion stroke time T180j for which the current combustion occurs in another cylinder #j. The time differences DT180j calculated with respect to the cylinders #j (j=1 to 4) are obtained in the following manner. A time difference DT180#3 (=T180#3−T180#1), for example, is calculated by subtracting the previous combustion stroke time T180#1 of the cylinder #1 from the current combustion stroke time T180#3 of the cylinder #3. The time differences DT180j are considered as an alternative parameter for angular acceleration of the crankshaft. If the value of the difference DT180j in a steady state is negative, that is, if the current combustion stroke time T180j is smaller than the preceding combustion stroke time T180j−1, then it is determined that a torque generated in the current combustion stroke of one cylinder #j is greater than a torque previously generated in the previous combustion stroke of another cylinder #(j−1).

A step 204 calculates T180AV which is the average of the four combustion stroke times T180j (j=1 to 4) required for the combustion stroke to occur in the respective cylinders (j). A step 205 calculates DT180AV, which corresponds to the average of the time differences DT180j, by the following formula:

$$DT180AV = \frac{1}{4}(T180AV(i) - T180AV(i-1)) \quad (1)$$

In this formula, T180AV(i) is the average of the combustion-stroke times of all the cylinders currently calculated in the step 204 and T180AV(i−1) is the average of the previous combustion-stroke times of all the cylinders previously calculated in the same step on the previous occasion. A step 206 calculates WDTj for each of the cylinders (j), which is the ratio of a difference, between each cylinder's time difference DT180j and the average DT180AV, to the average combustion stroke time T180AV, and this calculation is represented by the formula: WDTj=(DT180j−DT180AV)/T180AV. The influence due to the overall angular acceleration is eliminated by this calculation. If the value of the ratio WDTj is negative, or if it is smaller than zero, then it is determined that a torque generated in the current combustion stroke of the cylinder #j is greater than the average of the quantities of torque generated in all the cylinders.

A step 207 determines whether the engine, on the current occasion between 720 deg crank angles of the crankshaft, is in a fuel cut mode or in a fuel injection mode. When the throttle valve 39 is found as being set substantially in the closed position on the basis of the throttle position signal sent from the throttle position sensor 45 shown in FIG. 3, and the engine speed is found as being within a predetermined speed range on the basis of the crank angle signal sent from the crank angle sensor 30 shown in FIG. 2, it is determined in the step 207 that the engine is currently in the fuel cut mode, and then a step 209 is performed. When the engine is currently operating in a condition other than those described above, it is determined in the step 207 that the engine is currently not in the fuel cut mode, and then a step 208 is performed.

In the step 208, it is determined whether or not all the cylinders of the engine are in the fuel injection mode throughout the current cycle between 720 deg crank angles. In a case in which some of the cylinders are in the fuel injection mode but the others are in the fuel cut mode, the fuel injection correction routine ends. If the answer in the step 208 is affirmative, then a step 210 is performed.

In the step 209, a weighted average WDTSMCj(i) is calculated for each of the cylinders (j) by the following formula using the WDTj which have been calculated in the step 206, and the calculated WDTSMCj(i) are stored in the memory 33.

$$WDTSMCj(i) = WDTSMCj(i-1) + \frac{1}{8}(WDTj - WDTSMCj(i-1)) \quad (2)$$

In this formula, WDTSMCj(i) is the current value of the weighted average and WDTSMCj(i−1) is the previous weighted average which was calculated in the step 209 on the previous occasion. After the current values of the weighted average WDTSMCji have been calculated, a step 211 increments a counter CWDTC by one (CWDTC=CWDTC+1). The value of the counter CWDTC indicates the number of times of renewing the weighted average WDTSMCji.

In the step 210, a weighted average WDTSMBj(i) is calculated for each of the cylinders (j) by the following formula, using the WDTj which have been calculated in the step 206, and the calculated WDTSMBj(i) are stored in the memory 33.

$$WDTSMBj(i) = WDTSMBj(i-1) + \frac{1}{8}(WDTj - WDTSMBj(i-1)) \quad (3)$$

In this formula, WDTSMBj(i) is the current value of the weighted average and WDTSMBj(i−1) is the previous weighted average which was calculated in the step 210 on the previous occasion. After the current values of the weighted average WDTSMBji have been calculated, a step 212 increments a counter CWDTB by one (CWDTB=CWDTB+1). The value of the counter CWDTB indicates the number of times of renewing the weighted average WDTSMBji. The above described torque balance checking in the step 101 shown in FIG. 4 is carried out by performing the steps 201 through 212 shown in FIG. 5.

After either the step 211 or the step 212 has been performed, a step 213 determines whether or not the value of the counter CWDTB is greater than or equal to 8 and the value of the counter CWDTC is greater than or equal to 2. If the conditions of the step 213 are not satisfied, the values of WDTSMBj(i) or WDTSMCj(i) are considered unreliable and the fuel injection correction routine ends. If the above conditions are satisfied, the values of WDTSMBj(i) or WDTSMCj(i) are considered reliable and a step 214 is performed.

In this step 214, basic injection factors KTAUBj are calculated for respective cylinders (j) by the following formula.

$$KTAUBj = (KTAUj)(i-1) + \frac{1}{8}(WDTSMBj - WDTSMCj) \quad (4)$$

In this formula, (KTAUj)(i−1) are the previous values of the first correction factors which were calculated in step 216, which is described below, on the previous occasion between 720 deg crank angles. The initial values of the basic injection factors KTAUBj are equal to 1.0. As in the formula (4) above, the basic injection factors KTAUBj are calculated from the (KTAUj)(i−1) in accordance with the differences between the weighted averages WDTSMBj in the fuel injection mode and the weighted averages WDTSMCj in the fuel cut mode. The purpose of the calculation by the formula (4) is that only rotational speed changes occurring in each of the cylinders during the combustion condition are taken out by eliminating frictions of the cylinders. In short, the weighted averages WDTSMCj (j=1 to 4) in the fuel cut mode represent the rotation speed changes due to the above described frictions when each of the cylinders is not in the combustion condition and no torque is produced therein.

The average of the first correction factors KTAUj of the respective cylinders has to be equal to 1.0 because it is desired that the average air-fuel ratio of the mixture in the cylinders is not varied in accordance with the inter-cylinder correction process. A step 215 performs the following calculation.

$$KCTAU = \left(\frac{1}{4}\sum_{j=1}^{4} KTAUBj\right) - 1 \quad (5)$$

This KCTAU calculated in the step 215 indicates a difference between the average of the first correction factors KTAUj and 1.0. A step 216 calculates the first correction factors KTAUj by subtracting the difference KCTAU obtained in the step 215 from the basic injection factor KTAUBj. The above described steps 213 through 216 correspond to the step 102 shown in FIG. 4. In other words, the first calculation part 11 is realized by performing the steps 213 through 216 shown in FIG. 5.

A step 217 determines whether or not the absolute value of the difference between the weighted average WDTSMBj in the fuel injection mode and the weighted average WDTSMCj in the fuel cut mode is smaller than a predetermined value (which is equal to, for example, 0.01) for all the cylinders. The purpose of the inter-cylinder correction process is to bring the quantities of torque generated in the cylinders into the same level. When the inter-cylinder correction process ends normally, the rotational speed changes by the above described absolute value of the difference between WDTSMBj and WDTSMCj for the respective cylinders, are smaller than a predetermined level. When there is no torque variation between the cylinders, the absolute value of the difference between WDTSMBj and WDTSMCj is equal to 0.0 for all the cylinders. Therefore, if the answer in the step 217 is affirmative, it is assumed that the inter-cylinder correction process is completed normally, and a step 218 sets the correction completion flag XKITOU to one. If the answer in the step 217 is negative, it is assumed that the inter-cylinder correction process is still incomplete and a step 219 sets the correction-completion flag XKITOU to zero. Then, the inter-cylinder correction routine ends. The above described steps 217, 218 and 219 correspond to the steps 103, 104 and 105 shown in FIG. 4, respectively.

Figures 6A, 6B:
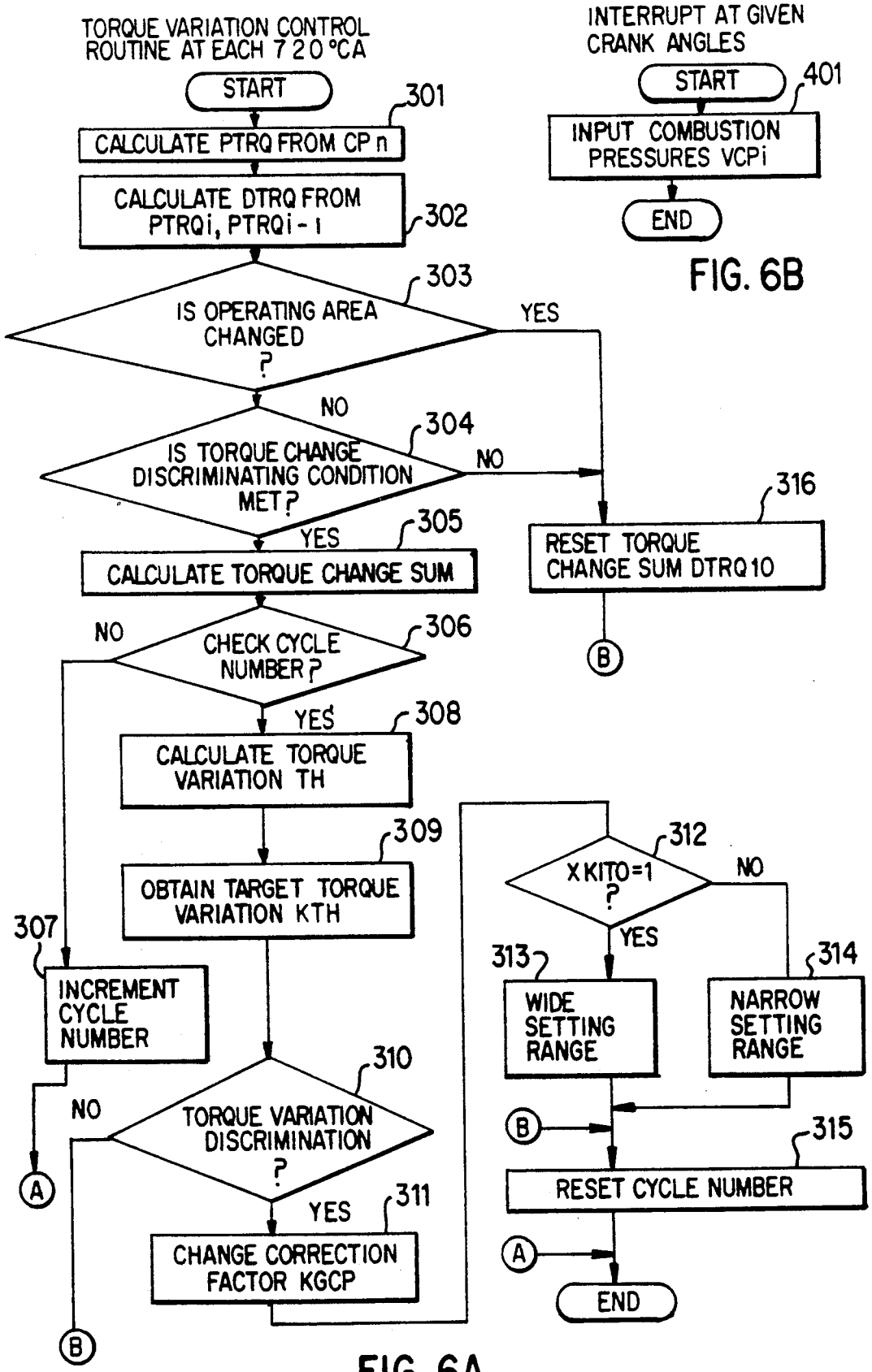
FIGS. 6A and 6B are flow charts for explaining a torque variation control routine which is performed in a first embodiment of the present invention.

Next, a description will be given of the torque variation control routine which is performed for carrying out the above described lean limit control. FIG. 6A shows a main routine for performing the torque variation control process. This main routine is initiated in the microcomputer 31 each time the crank angle is equal to 720 deg CA. FIG. 6B shows a subroutine for performing a cylinder-pressure introducing process, which subroutine is initiated by an interrupt each time the crank angle increases by a change of a predetermined angle. In the present embodiment, this predetermined angle is set to, for example, 30 deg CA. In the cylinder pressure introducing process, a step 401 converts an analog signal into a digital signal through analog-to-digital conversion, which analog signal indicates pressure in a combustion chamber of each of the engine cylinders and is input by the combustion pressure sensor 27 to the input interface 34 of the microcomputer 31. This digital signal indicating the combustion pressure in each of the cylinders is stored in the memory 33 of the microcomputer 31 each time the crank angle is increased by a change of 30 deg CA. More specifically, digital signals indicating combustion pressures when the crank angle supplied by the crank angle sensor 30 is equal to positions at BTDC (before top dead center) 155 deg CA, ATDC (after top dead center) 5 deg CA, ATDC 20 deg CA, ATDC 35 deg CA and ATDC 50 deg CA, are respectively stored in the memory 33.

Figure 8:
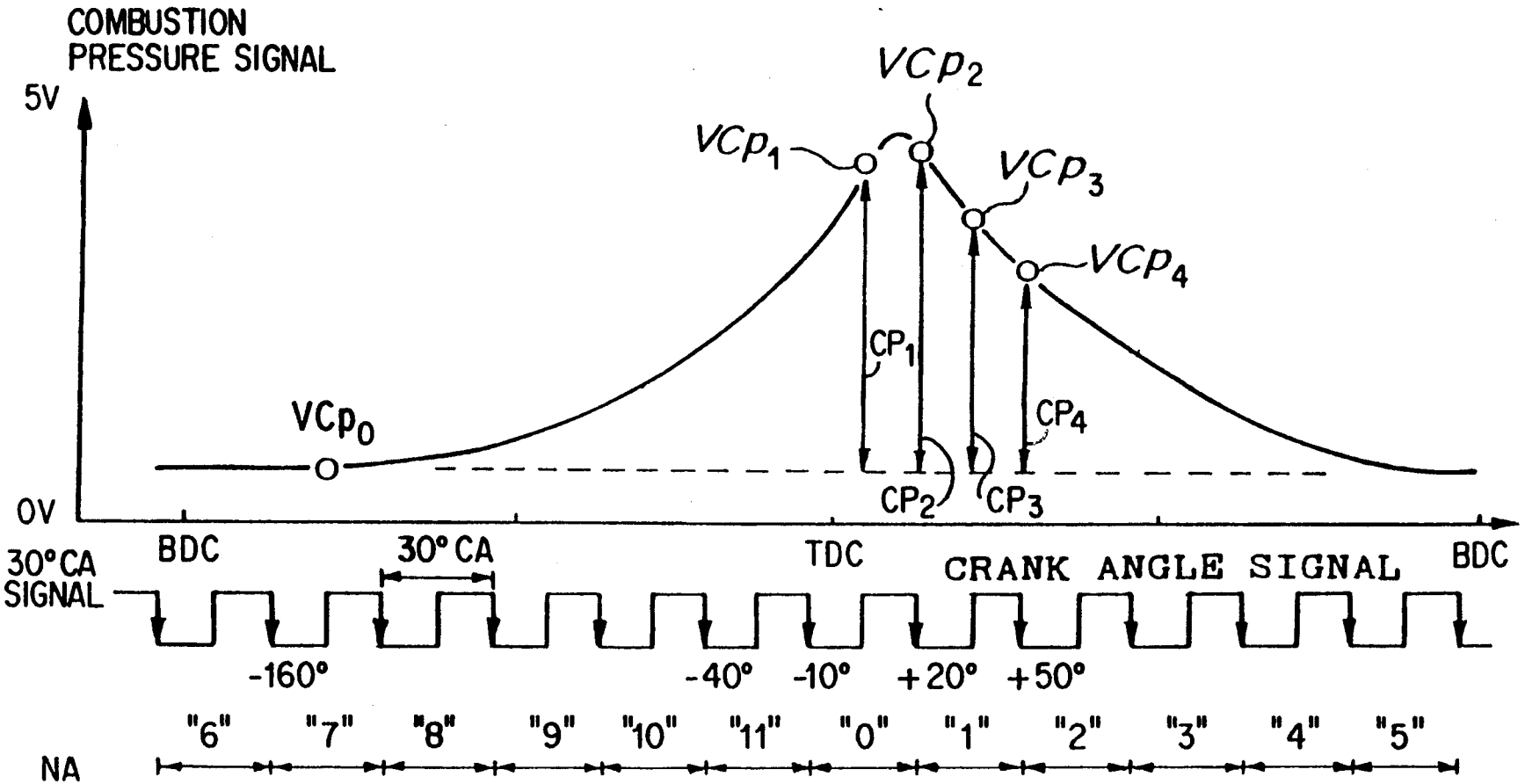
FIG. 8 is a chart showing a relationship between combustion pressure signals and crank angle signals.

FIG. 8 shows a relationship between the crank angle signals supplied by the sensor 30 and the combustion pressure signals supplied by the sensor 27. As described above, the subroutine shown in FIG. 6B is initiated by an interrupt which occurs repeatedly when the crank angle increases by changes of 30 deg CA. A 30 deg CA interrupt signal as shown in FIG. 8 is changed from OFF state to ON state each time the crank angle is changed by 30 deg CA. The ON state of the 30 deg CA interrupt signal corresponds to the first half of each 30 deg crank angle period, and the OFF state of the interrupt signal corresponds to the second half of the same, as shown. A combustion pressure signal VCPo when the crank angle is equal to the BTDC 155 deg CA position indicates a reference combustion pressure with which other combustion pressures at other crank angle positions are compared. The reason for the combustion pressure signal VCPo to be selected at such a crank angle is for absorbing the drift of output signals from the combustion pressure sensor 27 due to temperature changes and for reducing variations of offset voltage in the combustion pressure sensor 27.

In FIG. 8, four combustion pressure signals VCP1, VCP2, VCP3 and VCP4 correspond to crank angle positions at ATDC 5 deg CA, ATDC 20 deg CA, ATDC 35 deg CA and ATDC 50 deg CA, respectively. "NA" in FIG. 8 designates a value of an angle counter which is incremented one by one when an interrupt occurs at intervals of 30 deg CA of the crank angle, and the value of the angle counter is reset to zero each time the crank angle has reached 360 deg CA. The combustion pressure signals VCP2 and VCP4 at the ATDC 20 deg and ATDC 50 deg CA positions which are stored in the memory 33 are in accordance with the ON state of the 30 deg CA interrupt signal, but the combustion pressure signals VCP1 and VCP3 at the ATDC 5 deg and 35 deg CA positions are not in accordance with the ON state of the 30 deg CA interrupt signal. The analog-to-digital conversion and memory storing of the combustion pressure signals VCP1 and VCP3 at these crank angle positions are interrupted in the CPU 32 by a timer in which the corresponding interrupts are preset at these crank angle positions.

The main routine shown in FIG. 6A is initiated each time the crank angle reaches 720 deg CA, and the torque variation control process is performed once at every 720 deg CA. In the main routine, a step 301 calculates the quantities of crankshaft torque in the cylinders on the basis of the combustion pressure signals VCPo, VCP1, VCP2, VCP3 and VCP4 Which are each stored in the memory 33 in the above step 401. In the step 301, combustion pressures CPn (n=1 to 4) are calculated by subtracting a reference combustion pressure indicated by the reference combustion pressure signal VCPo from each of combustion pressures indicated by the combustion pressure signals VCPn (n=1 to 4), as follows.

$$CPn\ 32\ K1\times(VCPn-VCPo)(n=1\text{ to }4) \quad (6)$$

In this formula, K1 is a correction coefficient which is determined based on the characteristics between combustion pressure signal and combustion pressure. Then, the crankshaft torque PTRQ for each of the cylinders is calculated from the thus obtained combustion pressures CPn (n=1 to 4) by the following formula.

$$PTRQ=K2\times(0.5CP1+2CP2+3CP3+4CP4) \quad (7)$$

In this formula, K2 is a correction coefficient which is determined based on the combustion pressure vs. torque characteristics. A step 302 calculates a cycle-by-cycle torque change of each of the cylinders by the following formula.

$$DTRQ=PTRQ(i-1)-PTRQ(i)(DTRQ\geqq 0) \quad (8)$$

Figures 9A, 9B, 9C, 9D, 9E:
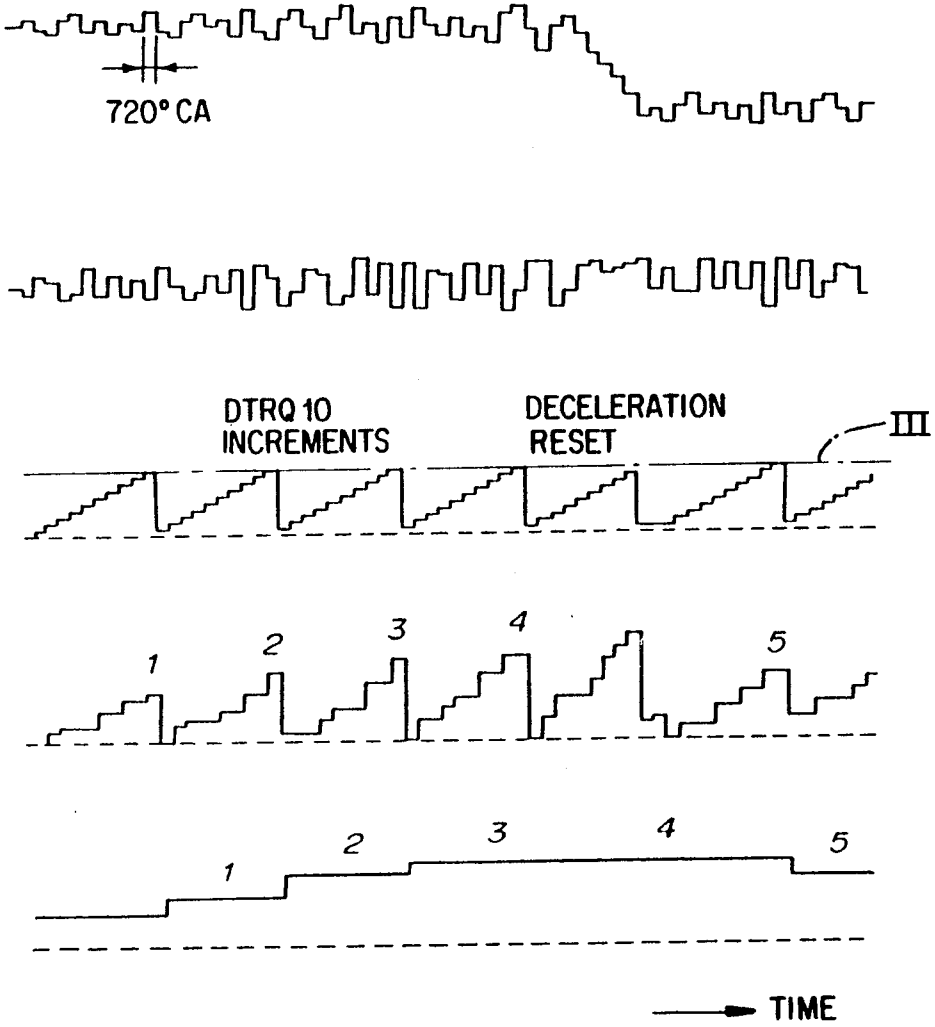
FIGS. 9A through 9E are time charts showing changes in the crankshaft torque, the torque changes, the cycle number, the torque change sum and the integrated torque change sum.

In this formula, PTRQ(i) is the current crankshaft torque of the subject cylinder generated during the current cycle, and PTRQ(i−1) is the previous crankshaft torque of the same cylinder generated during the previous cycle. As indicated by the formula (8) above, the cycle-by-cycle torque change is a difference between the current crankshaft torque and the previous crankshaft torque. In the present embodiment, it is assumed that a torque change actually takes place only when the value of the calculated torque change DTRQ is greater than zero, in other words, when the current crankshaft torque is decreased from the previous crankshaft torque. When the calculated crankshaft torque is not greater than zero, the torque change in such a case is negligible because it can be determined that the crankshaft torque changes along the line of a theoretical torque change chart (not shown). In a case where the crankshaft torque PTRQ, with respect to one of the cylinders obtained by the formula (7), is varied in a manner as shown in FIG. 9A, the value of the torque change DTRQ obtained by the formula (8) is varied in a manner as shown in FIG. 9B.

A step 303 determines whether or not an operating area NOAREA(i) indicating current driving conditions of the engine in the current cycle has changed from an operating area NOAREA(i−1) indicating the previous driving conditions thereof in the previous cycle. If the operating area has not changed, a step 304 determines whether or not a torque change discrimination condition is satisfied. A torque change discrimination value KTH (or, a target torque change quantity), which is described below, is preset for each operating area. There are several cases in which the torque change discrimination condition is not satisfied. These include cases in which the engine is in deceleration condition, in dling condition, in starting condition, in warm-up condition, in EGR ON condition, in fuel cut condition and so on. Therefore, when the engine operation is applicable to none of the above cases, the step 304 determines that the torque change discrimination condition is satisfied, and a step 305 is performed. In this regard, when the cycle-by-cycle torque change DTRQ is greater than zero in five consecutive cycles or more, it is determined that the engine is in deceleration condition. When the engine is in deceleration condition, it is very difficult to distinguish a torque reduction due to a decrease in the intake air quantity from a torque reduction due to a decrease in the combustion efficiency, and the engine control operation based on the torque changes is stopped.

The step 305 calculates the sum DTRQ10(i) of the cycle-by-cycle torque changes by adding the current torque change DTRQ, obtained in the step 302, to the previous torque change DTRQ10(i−1) obtained in the previous cycle, as follows:

$$DTRQ10(i)=DTRQ10(i-1)+DTRQ \quad (9)$$

A step 306 checks whether or not the number of repeated cycles (which is referred to as a cycle number CYCLE10) has reached a predetermined number. This predetermined number in the present embodiment is, for example, 10. If the cycle number CYCLE10 has not reached 10, a step 307 increments the cycle number CYCLE10 by one, and the torque variation control routine ends. And, the main routine shown in FIG. 6A is initiated again when the crank angle has reached 720 deg CA in the following cycle.

In the above described manner, the torque variation control routine shown in FIG. 6A is repeated until the cycle number CYCLE10 reaches the predetermined number. When the predetermined number is reached by the cycle number CYCLE10, it is determined that the sum of the torque changes calculated in the step 305 is approximately equal to a correct sum of the actual torque variations. A step 308 then calculates a torque variation TH by the following formula.

$$TH=1/16(DTRQ10(i)-TH(i-1))+TH(i-1) \quad (10)$$

In this formula, TH(i−1) is the previous value of the torque variation calculated in the step 308 on the previous occasion, DTRQ10(i) is the current value of the torque change sum calculated in the step 305 on the current occasion. As is readily understandable from the formula (10) above, the current torque variation TH is a weighted average of the current torque change sum DTRQ10(i) and the previous torque variation TH(i−1) and a weight factor in the case is equal to 1/16.

After the calculation of the torque variation TH has been done, a step 309 determines a target torque variation KTH from a two-dimensional map which is stored beforehand in the memory 33 and include target torque variations predetermined in a relationship between engine speed and intake air quantity.

Next, a step 310 performs a torque variation discrimination by determining whether or not the value of the current torque variation TH obtained in the step 308, lies within (i) a first range represented by $KTH-a<TH<KTH$, (ii) a second range represented by $TH\geqq KTH$, or (iii) a third range represented by $TH\geqq KTH-a$. In this regard, a indicates a width of an insensitive range of the engine control apparatus according to the present invention.

If it is determined in the step 310 that the torque variation TH falls within (i) the first range of $KTH-a<TH<KTH$ (which is called an insensitive range), a step 315 resets the cycle number CYCLE10 to zero and the torque variation control routine ends. If it is determined in the step 310 that the torque variation TH falls within either (ii) the second range or (iii) the third range, a step 311 changes a fuel injection correction factor KGCP for adjusting the fuel injection quantity of each of the four cylinders. This fuel injection correction factor KGCP corresponds to the second correction factor calculated by the above mentioned second calculation part 12; the value of the correction factor KGCP is the same for all the cylinders. The second calculation part 12 of the present invention is realized by performing the step 311.

When the step 310 determines that the torque variation TH falls within (ii) the second range, the value of the torque variation TH is greater than that of the target torque variation KTH, that is, the TH is deviating from the target KTH to a greater value. Therefore, the fuel injection correction factor is changed in the step 311 so as to increase fuel injection and make the air-fuel mixture rich. In this case, the fuel injection correction factor KGCP is changed by adding a constant to the previous fuel injection correction factor as follows.

$$KGCP(i)=KGCP(i-1)+0.01 \quad (11)$$

In this formula, KGCP(i−1) is the previous fuel injection correction factor and KGCP(i) is the current fuel injection correction factor.

When the step 310 determines that the torque variation TH falls within (iii) the third range, the value of the torque variation TH is smaller than that of the target torque variation KTH, that is, the TH is deviating from the target KTH to a value smaller than the insensitive range. Therefore, the fuel injection correction factor KGCP is changed in the step 311 so as to decrease the fuel injection and make the air-fuel mixture lean. In this case, the fuel injection correction factor KGCP is changed by subtracting a constant from the previous fuel injection correction factor as follows.

$$KGCP(i)=KGCP(i-1)-0.01 \quad (12)$$

The fuel injection correction factor KGCP calculated in the step 311 is stored in a corresponding learning area of the two-dimensional map stored in the memory 33, and the calculated KGCP in the learning area describes a characteristic between engine speed NE and intake air quantity QNSM. The two-dimensional map, which may be, for example, one shown in FIG. 11, includes a set of learning areas K00 through K34 into which the characteristic data is divided in a regular manner. The area in which the calculated factor KGCP is stored corresponds to one of the learning areas K00 through K34 of the two-dimensional map.

A step 312 checks whether or not the value of the above described correction-completion flag XKITOU is equal to 1 or not. When the correction completion flag XKITOU is set to 1, the inter-cylinder fuel injection correction process has been completed, and a step 313 sets the upper and lower limits of the fuel injection correction factor KGCP in a wide range ($0.8 \leqq KGCP \leqq 1.2$). On the other hand, when the correction completion flag is set to 0, the inter-cylinder fuel injection correction process has not been completed, and a step 314 sets the upper and lower limits of the fuel injection correction factor KGCP in a narrow range ($0.9 \leqq KGCP \leqq 1.2$). According to the present invention, the setting range within which the fuel injection correction factor KGCP can change is variable depending on whether or not the inter-cylinder fuel injection correction process has been completed in such a way that a first setting range within which the fuel injection correction factor KGCP can change when the fuel injection correction has not been completed is narrower than a second setting range within which the fuel injection correction factor KGCP can change when the inter-cylinder fuel injection correction has been completed. In the present embodiment, the upper and lower limits of the fuel injection correction factor (the upper limit=1.1, the lower limit=0.9) when the fuel injection correction has not been completed are respectively smaller than those of the fuel injection correction factor (the upper limit=1.2, the lower limit=0.8) when the fuel injection correction has been completed. Also, in the present embodiment, the upper and lower limits of the fuel injection correction factor are varied so that the driveability is not affected significantly if some degree of torque variation remains in one of the cylinders. The above mentioned modification part 15 of the present invention is realized by performing the step 314.

After either the step 313 or the step 314 has been performed, the step 315 resets the cycle number CYCLE10 to zero and the torque variation control routine ends. When the step 303 determines that the operating area is changed, or when the step 304 determines that the torque change discriminating condition is not met, a step 316 resets to zero the torque change sum DTRQ10, calculated in the step 305. Then, the step 315 resets the cycle number CYCLE10 to zero, and the torque variation control routine is completed.

Figures 6C, 6D:
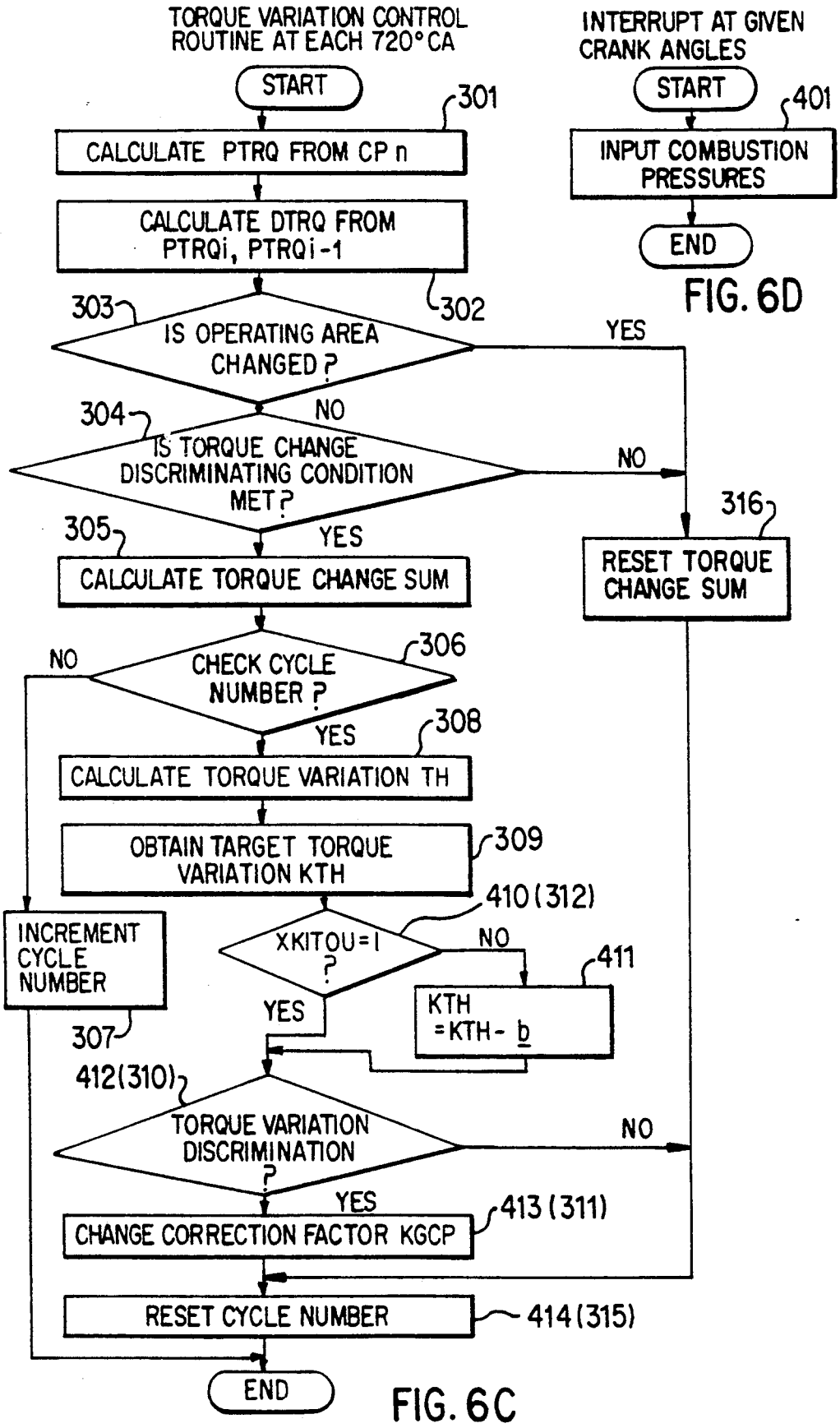
FIGS. 6C and 6D are flow charts for explaining a torque variation control routine which is performed in a second embodiment of the present invention.

Next, a description will given of a second embodiment of the present invention, with reference to FIGS. 6C and 6D. FIGS. 6C and 6D show a torque variation control routine which is performed in the second embodiment. The steps 301 through 309 shown in FIG. 6C and the step 401 shown in FIG. 6D (they are designated by the same reference numerals) are the same as those corresponding steps shown in FIGS. 6A and 6B, respectively, and a description thereof will be omitted.

After the calculation of the torque variation TH in the step 308 has been done, the step 309 determines a target torque variation KTH from the two-dimensional map which is stored beforehand in the memory 33 and which includes target torque variations in a relationship between engine speed and intake air quantity. In the second embodiment of the present invention, a step 410 checks whether the correction-completion flag XKITOU is set to 1 or 0. This step 410 corresponds to the step 312 shown in FIG. 6A. When the correction-completion flag XKITOU is set to one, the inter-cylinder fuel injection correction process has been completed, and a step 412 is next performed. When the correction-completion flag is set to zero, the inter-cylinder fuel injection correction process has not been completed, and a step 411 subtracts a predetermined value b from the target torque variation KTH calculated in the step 309 (KTH=KTH−b). Then, the step 412 is performed based on the target torque variation KTH after the subtraction in the step 411. Therefore, the above mentioned modification part 15 of the present invention is realized by performing the step 411.

Concerning the second embodiment, the target torque variation KTH which was calculated in the step 309 indicates a relatively great value which is approximately equal to a lean-side limit of the torque variation. The calculated value of the target torque variation KTH after the subtraction in the step 311, which is smaller than the previous value of the KTH calculated in the step 309 (KTH=KTH−b), is greater than a target torque variation KTHo which corresponds to a stoichiometric value of the air-fuel ratio in the engine.

The step 412 performs a torque variation discrimination by determining whether the current value of the torque variation TH obtained in the step 308 lies within (i) the first range represented by ( KTH−a<TH<KTH), (ii) the second range represented by (TH≧KTH), or (iii) the third range represented by (TH≧KTH−a). The steps 412, 413 and 414 shown in FIG. 6C are the same as the steps 310, 311 and 315 shown in FIG. 6A, respectively.

Several modifications of the above described second embodiment may be made according to the present invention. For example, the calculation of the target torque variation KTH when the inter-cylinder fuel injection correction process has been completed can be made by changing the predetermined value b in accordance with an operating condition of the engine such as the engine speed and the load. When the engine is operating in a high-speed, heavy-load condition, the engine operation is relatively stable, and the predetermined value b is changed so as to become smaller than in the case in which the engine is in a low-speed, light-load operating condition.

By performing repeatedly the torque variation control routine as shown in FIGS. 6A through 6D, the cycle number CYCLE10 is repeatedly incremented in such a manner as shown in FIG. 9C. Only when the step 306 determines that the cycle number CYCLE10 has reached a predetermined reference value (which is equal to, for example, 10), the step 315 shown in FIG. 6A (or, the step 414 shown in FIG. 6C) resets the cycle number CYCLE10 to zero. A line III shown in FIG. 9C indicates the level of the predetermined reference value with which the cycle number CYCLE10 is compared in the step 306. FIG. 9D shows how the cycle-by-cycle torque changes DTRQ are totaled each time the cycle number CYCLE10 is incremented, and FIG. 9E shows the changes in the torque change sum DTRQ10 which sum is the result of totaling the torque changes DTRQ repeatedly ten times.

Figure 10A:
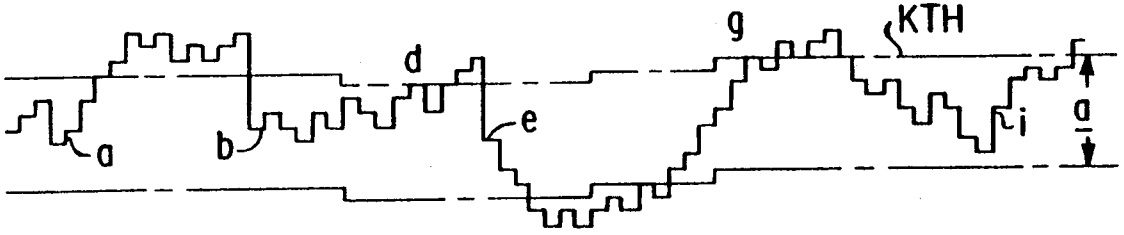
FIGS. 10A through 10C are timing charts showing changes in the injection correction factors and torque variations.
Figure 10B:
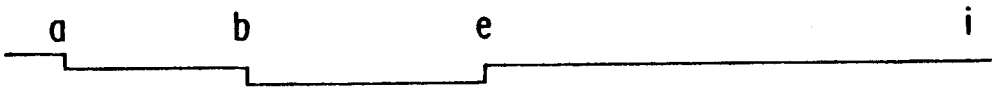

FIG. 10A shows changes in the torque variation TH. It is assumed that the operating area of the engine is changed at times indicated by "a", "b", "e" and "i" in FIG. 10A. This operating area change is checked in the step 303 on the basis of engine speed and intake air quantity of the engine at that time. In accordance with the operating area changes, the learning area in which the fuel injection correction factor KGCP is stored is changed in a manner as shown in FIG. 10B. The target torque variation KTH which is obtained from the two-dimensional map in the memory 33 through an interpolation method is changed in a manner shown in FIG. 10A.

Figure 10C:
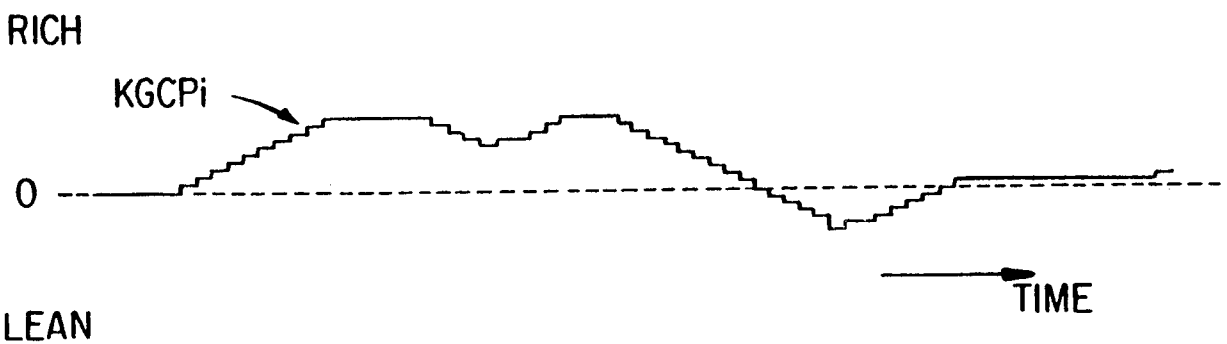

When the torque variation TH is changed and exceeds the target torque variation KTH (TH≧KTH) immediately after a time indicated by "a" or at times indicated by "d" and "g" in FIG. 10A, the fuel injection correction factor KGCP(i), which is modified by the formula (11), is gradually increased in a manner as shown in FIG. 10C. When the torque variation TH is changed so as to fall within the third range (TH≦KTH−a) at a time indicated by "f" in FIG. 10A, the fuel injection correction factor KGCP(i) which is modified by the formula (12) is gradually decreased in a manner as shown in FIG. 10C.

Figure 7:
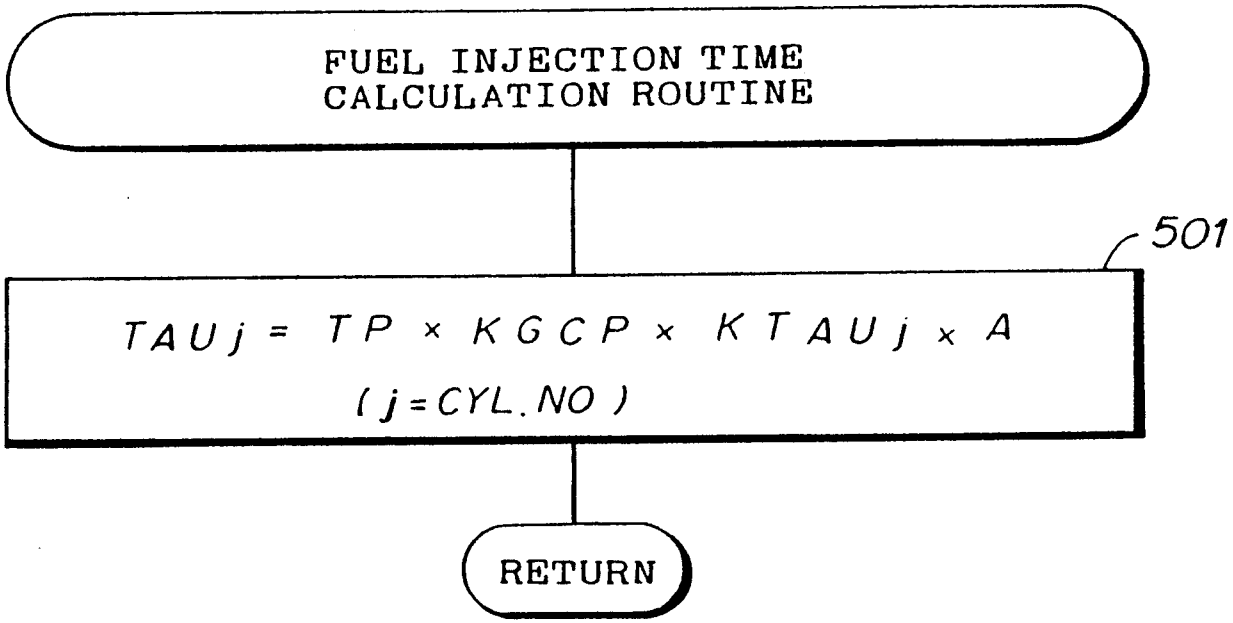
FIG. 7 is a flow chart for explaining a fuel injection time calculation routine which is performed according to the present invention.

Next, a description will be given of a fuel injection control process with reference to FIG. 7. The above mentioned control part 13 of the present invention is realized by performing the fuel injection control process by means of the microcomputer 31. FIG. 7 shows a fuel injection time calculating routine, and this routine is initiated each time the crank angle reaches a predetermined angle which is equal to, for example, 360 deg CA. In the fuel injection time calculating routine, a step 501 calculates a fuel injection time TAU(i) with respect to each of the cylinders. In the step 501, an intake air quantity QN and an engine speed NE are read out from the memory 33, and a basic injection time TP is calculated from these data QN and NE by the following formula.

$$TP = K\ QN/NE$$

In this formula, K is a given coefficient. The first correction factors KTAUj and the fuel injection correction factor KGCP mentioned above are read out from the memory 33; a fuel injection time TAU(i) with respect to each of the cylinders is calculated from the data TP, KTAUj and KGCP by the following formula.

$$TAU(i) = TP \times KGCP \times KTAUj \times A \quad (13)$$

In this formula, A is a correction factor related to several factors including a fuel increase during warm-up operation, and a fuel increase after engine starting. Thus, the fuel injection is carried out by the fuel injection valves 25-1 through 25-4 of the cylinders #1 through #4 on the basis of the thus calculated fuel injection times TAU(i) (i=1 to 4).

Hence, according to the present invention, when the torque variation TH (in the step 310) lies in the first range (KTH−a<TH<KTH), which is called the insensitive range, the fuel injection correction factor KGCP falls within a prescribed range and fuel injection is carried out by the engine control apparatus in such a way that the air-fuel ratio is adjusted and the air-fuel mixture is as lean as possible.

When the torque variation TH lies in the second range (TH≧KTH), the fuel injection correction factor KGCP is increased according to the formula (11) so as to become greater than the previous level by a given constant (=0.01). The fuel injection time TAU(i) calculated by the formula (13) is therefore increased, the fuel injection quantity thereby becoming greater and the air-fuel mixture becoming rich. The torque variation TH is adjusted in the subsequent cycles so that it decreases and becomes smaller than a level indicated by KTH.

When the torque variation TH lies in the third range (TH≧KTH−a), the fuel injection correction factor KGCP is decreased according to the formula (12) so as to make it smaller than the previous level by a constant (=0.01). The fuel injection time TAU(i) calculated by the formula (13) is thus decreased, the fuel injection quantity thereby becoming small and the air-fuel mixture becoming lean. The torque variation TH is adjusted in the subsequent cycles so that it increaes and becomes greater than a level indicated by (KTH−a).

Thus, the lean limit control process is carried out according to the present invention. In addition, a setting range in which the fuel injection correction factor KGCP can be modified is changed depending on whether the inter-cylinder fuel injection correction process has been completed or not. If the correction process has not been completed, a lower limit of the first correction factors KTAUj (included in the formula (13)) is changed to a value greater than a lower limit of the same in a case in which the correction process has been completed. A lower limit of the fuel injection time TAU calculated by the formula (13) is thus increased, and the fuel injection control is carried out in such a condition. Accordingly, even when the inter-cylinder fuel injection correction process has not been completed, the lean limit control is performed and the degree of adjustment is relatively small, thereby producing no misfire in the cylinders.

In addition, according to the present invention, if the inter-cylinder fuel injection correction process has not been completed, an upper limit of the first correction factors KTAUj is changed to a smaller value than an upper limit of the same in a case in which the correction process has been completed. An upper limit of the fuel injection time TAU calculated by the formula (13) is thus decreased, and the fuel injection control is carried out in such a condition. Accordingly, even when there is a certain degree of variations among the cylinders, it is possible to prevent the driveability from deteriorating when the inter-cylinder fuel injection correction has not been performed.

Further, the present invention is not limited to the above embodiments, and variations and modifications may be made without departing from the scope of the present invention. For example, it is possible for the step 314, shown in FIG. 6A, to set the lower limit only of the KGCP to 0.9, without changing the upper limit thereof. In such a modified embodiment, it is possible to prevent a misfire from occurring in the cylinder even when the inter-cylinder correction process has not been completed.

In the above described embodiments, the fuel injection time of each of the cylinders is adjusted by modifying the fuel injection correction factor KGCP (the step 311 in FIG. 6A or the step 413 in FIG. 6C) and performing the fuel injection time calculation routine (shown in FIG. 7), so that the torque variation TH is approximately equal to the target torque variation KTH. In order for obtaining a desired torque variation, it is possible to adjust the amount of recirculated exhaust gas (EGR amount) instead of the fuel injection time. In such a modified embodiment, an exhaust gas passage is provided so as to be connected between the exhaust manifold 24 shown in FIG. 3 and the intake passage 26 at a portion downstream of the throttle valve 39, for recirculating exhaust gas from the exhaust manifold 24 into the intake manifold 23. And, a vacuum switching valve (VSV) is provided at an intermediate portion of the exhaust gas passage, the valve opening position of which is controlled by means of the microcomputer 31. If it is necessary to increase the torque variation, the valve opening position of the VSV is adjusted so as to be a greater value for increasing the EGR amount. In a manner as described above, the present invention is applicable to an internal combustion engine in which the torque variation control is carried out by correcting an engine control parameter (such as the fuel injection quantity, the EGR amount, etc.) by changing the first correction factors and the torque variation correction factors.

What is claimed is:

1. An engine control apparatus comprising:

first calculation means for calculating first correction factors with respect to a plurality of cylinders of an internal combustion engine, the first correction factors being calculated so as to make the quantities of torque generated in the cylinders substantially agree with one another;

second calculation means for calculating a second correction factor with respect to the plurality of cylinders so that a cycle-by-cycle torque variation in at least one of the cylinders is changed so as to substantially agree with a target torque variation;

control means for generating a control parameter with respect to each of the cylinders for appropriate operation of the internal combustion engine, on the basis of said first correction factors and said second correction factor;

discrimination means for judging whether or not an inter-cylinder correction routine has been completed based on the first correction factors, so that the quantities of torque generated in the cylinders substantially agree with one another; and modification means for modifying a range within which the second correction factor can change into a narrower range when it is judged by the discrimination means that the inter-cylinder correction routine has not been completed, thereby allowing said control means to generate said control parameter based on the first correction factors and the second correction factor even when the inter-cylinder correction routine is being performed.

2. The apparatus as claimed in claim 1, wherein said second calculation means calculates a second correction factor so that said second correction factor falls within a guard range between a lower limit and an upper limit, and said modification means changes at least one of the upper and lower limits of said second correction factor into a new limit value when said discrimination means judges that the inter-cylinder correction routine has not been completed, in such a way that a torque variation corresponding to said new limit value, changed from said one of the upper and lower limits of said second correction factor, is smaller than a torque variation corresponding to the other limit thereof.

3. The apparatus as claimed in claim 2, wherein said calculation of the second correction factor is made by the second calculation means in each operation cycle before the discrimination means judges whether or not the inter-cylinder correction routine has been completed.

4. The apparatus as claimed in claim 1, wherein said modification means changes the target torque variation into a smaller value if it is judged by the discrimination means that the inter-cylinder correction routine has not been completed, said value of the changed target torque variation being smaller than a value of the target torque variation when the inter-cylinder correction routine has been completed.

5. The apparatus as claimed in claim 4, wherein the second calculation means calculates the second correction factor in each operation cycle after the discrimination means judges whether or not the inter-cylinder correction routine has been completed.

6. The apparatus as claimed in claim 1, wherein said target torque variation is determined in response to a relationship between engine speed and intake air quantity of the internal combustion engine in each operation cycle, from a two-dimensional map previously stored in a memory included in a microcomputer.

7. The apparatus as claimed in claim 1, wherein said control parameter generated by said control means is a fuel injection time with respect to each of the cylinders.

8. The apparatus as claimed in claim 1, wherein said control parameter generated by the control means is an exhaust gas recirculation quantity with respect to the internal combustion engine.

9. The apparatus as claimed in claim 4, wherein said target torque variation is determined in response to a relationship between engine speed and intake air quantity of the internal combustion engine in each operation cycle, from a two-dimensional map previously stored in a memory included in a microcomputer.

10. The apparatus as claimed in claim 1, wherein said second calculation means calculates a second correction factor so that said second second correction factor falls within a guard range between a lower limit and an upper limit, and said modification means changes both the upper and lower limits of said second correction factor into new limit values when said discrimination means judges that the inter-cylinder correction routine has not been completed, in such a way that the upper limit is changed into a limit value smaller than that when said routine has been completed while the lower limit is changed into a limit value greater than that when said routine has been completed, said second correction factor thereby falling within a narrower guard range between said limits values.

* * * * *